US005440858A

United States Patent [19]

Hinkes

[11] Patent Number: 5,440,858

[45] Date of Patent: Aug. 15, 1995

[54] INSTANT GAME COURT ON A HARD SURFACE AND PROCESS FOR APPLYING THE PRODUCT THERETO

[76] Inventor: Mark P. Hinkes, 7800 SW. 87 Ave., Suite B-270, Miami, Fla. 33173

[21] Appl. No.: 198,121

[22] Filed: Feb. 16, 1994

[51] Int. Cl.[6] ..... A63C 19/06

[52] U.S. Cl. ..... 52/741.1; 273/1.5 R; 273/31; 427/282; 427/136

[58] Field of Search ..... 427/136, 137, 282; 273/1.5 R, 31, 411; 404/9, 14; 52/741.1

[56] References Cited

U.S. PATENT DOCUMENTS 4,236,950 12/1980 Eigenmann ..... 427/137 X
4,510,729 4/1985 Syring ..... 427/282 X
4,834,392 5/1989 Nixon ..... 273/411
5,124,178 6/1992 Haenggi et al. ..... 427/136 X
5,186,983 2/1993 Brown ..... 427/282 X

*Primary Examiner*—Christopher Todd Kent
*Attorney, Agent, or Firm*—Malloy & Malloy

[57] ABSTRACT

A system and process for forming an instant, fixedly attached but removable game court on any type of concrete, black-top, asphalt, or like outdoor hard surface, which allows a game involving frictional contact of the players with the hard surface to be played on the game court without the removal of the game court, and the subsequent easy removal of the game court by rinsing of the hard surface with water from a conventional garden hose or by natural rainwater.

10 Claims, 1 Drawing Sheet

INSTANT GAME COURT ON A HARD SURFACE AND PROCESS FOR APPLYING THE PRODUCT THERETO

BACKGROUND OF THE INVENTION

1. Field of the Invention

This invention relates to a system for forming an instant game court which may be easily removed from an outdoor court having a hard surface and also to a process of composing and applying a marking material to the outer exposed surface of the outdoor court to form the game court.

2. Description of the Related Art

With the popularity of basketball, many homes have installed their own basketball equipment. Such equipment usually includes a pole, backboard, hoop, and net. Typically, equipment of this type does not include the details of installing a game (playing) court, or more specifically the outline of the game court, on any type of outdoor concrete, asphalt, black-top or like hard surface. The lines forming the areas of the game court, such as the side boundary lines, the foul line, the lines where players stand during a foul shot, and the three point line, are therefore missing from such make-shift domestic courts. Also, the size of the area of the available outdoor surface normally necessitates only a "half-court" game court being utilized.

In order to enhance the playing of the game of basketball, or any other game for which it is desired to temporarily apply and use a defined game court, a desirable effect would be to mark such domestic courts with the court lines.

Naturally, other types of game courts in professional, amateur, or more organized leagues are available and known in the prior art.

For example, U.S. Pat. No. 4,510,692 to Overholser et al. discloses a template for marking batter's and catcher's boxes of a baseball diamond in conformance with league or other standard regulations. The structure disclosed in the Overholser patent includes a rectangular frame template with dimensions having a preselected relationship to the type of boxes or portions of the batting area being formed. The template is of a rigid format or construction which may be adjusted and sized to define the dimensions of the batting area being formed. However, to form the typical batter's box or catcher's box, the outline or boundaries defined by the aforementioned template are marked in with chalk or other like material which can readily be removed by scuffing, sliding, or other frictional contact with the applied chalk lines. This is typical with all types of professional, amateur, or regulated outdoor sporting events.

However, when it is desired to install a game court for a game such as basketball which is normally played on a hard court surface, the placement of chalk or another easily removable substance on such hard surface to outline the court lines, as taught by the Overholser patent, does not result in the formation of a fixedly attached game court.

U.S. Pat. No. 3,994,497 to Cordingely discloses a baseball-like game apparatus including a playing surface marked to define a triangular area having a pair of foul lines, a defensive base line, etc. Indicia are located within the triangle to define the placement of locations of bases or other objects. This patent, however, relates primarily to a physical apparatus used to outline a game court and does not disclose a desirable marking material that can be fixedly yet removably applied to a hard surface court, such as an outdoor concrete or asphalt surface, to form the game court lines.

Other U.S. patents that are generally representative of structures or processes for forming game courts, but which appear to be primarily of secondary interest only, include Theriot, U.S. Pat. No. 3,865,371; DeVos, U.S. Pat. No. 3,822,883; Nehl, U.S. Pat. No. 3,226,118; Safina, et al., U.S. Pat. No. 3,393,913; and Raub, U.S. Pat. No. 4,880,243.

Accordingly, there is still a need for a system that can easily and accurately forman "instant" game court which during play remains fixedly attached to the exposed surface of an outdoor hard court surface made of concrete, asphalt, or blacktop, and is generally resistant to removal by scuffing, scraping, sliding, or other such frictional contact. However, the game court should be capable of being easily removed when the court is no longer desired for use, by rinsing with a hose or like facility or through nature's own rain water.

SUMMARY OF THE INVENTION

The present invention relates to a system and process for temporarily but fixedly and removably forming a game court on preferably an outdoor surface, such as but not limited to a hard court surface of concrete or asphalt. The subject system and process may be particularly applicable for domestic use in non-organized sports games such as a pickup game of basketball wherein the game court can be formed in a driveway or other applicable surface areas where the necessary equipment such as a basketball hoop, pole, and backboard has already been permanently installed. The system includes a non-toxic, clay-based marking material in powder form, which is mixed with a predetermined amount of water to produce a liquid solution that is easily applied to the exposed surface of the outdoor court so as to form the game court lines, the outline of which has previously been defined on the outdoor surface. A coloring agent may be added to the marking material to produce game court lines of a desired color. Application of the liquid solution of marking material can be accomplished by the use of any conventional applicator means, including but not limited to a paintbrush, paint roller, spray can, or spray gun.

The means utilized to define the game court lines that will be formed by application of the marking material can be as simple as the placement of temporary erasable guidelines on the hard surface using a carpenter's "chalk line". To ensure a high degree of accuracy in the formation of the game court, however, the game court defining means may be a template or stencil structure. The preferred embodiment of the invention includes a template structure formed of a flexible, lightweight foldable material which is capable of being rolled or folded upon itself for storage when not being used.

A feature of the present invention is that the marking material, once formed into a solution and applied to the hard surface in the configuration of the intended game court, is not easily removed by scuffing, sliding, scraping or other frictional contact. The present invention therefore overcomes a significant disadvantage normally encountered when a game court such as a baseball diamond is formed with chalk or other such substance that is easily removed by frictional contact. Even in the professional ranks, the batter's box and catcher's box must be periodically re-formed due to the players' sliding and scuffing which tends to remove the chalked lines forming the batter's box or catcher's box.

In contrast to chalk and like substances, the marking material of the present invention becomes fixedly secured to the outer exposed surface of the hard concrete or black-top surface to the extent that it is highly resistant to removal from its intended location or configuration by scuffing, sliding, or other frictional contact. When it is desired to remove the game court, however, such removal can easily be accomplished by thoroughly rinsing the court with water, as from a garden hose, or otherwise allowing the court to be rained upon.

It should be emphasized that while a basketball court is discussed at length in the detailed description below, other types of game courts for different games can be formed utilizing the present invention. One such game could of course include hopscotch, which is typically played on a sidewalk area made of concrete or like hard surface material. In the preferred embodiment of the invention, each different game court to be formed would require a separate template structure of a predefined shape and dimension which would be laid out in the appropriate orientation on the outdoor hard surface where the game is to be played, for subsequent application of the marking material along the game court configuration defined by the template structure.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
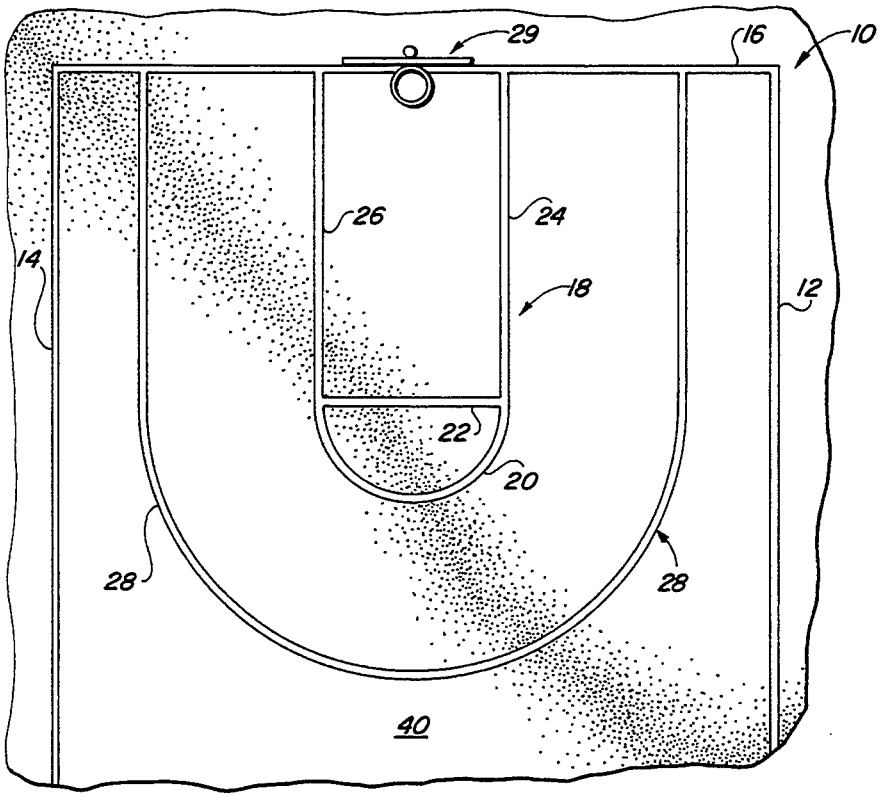
FIG. 1 is a schematic view of a game court formed by the marking material of the present invention.
Figure 5:
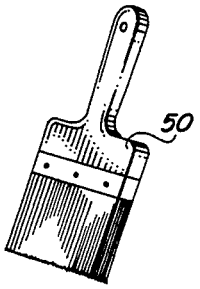
FIG. 5 is an applicator structure in the form of a paintbrush.
Figure 3:
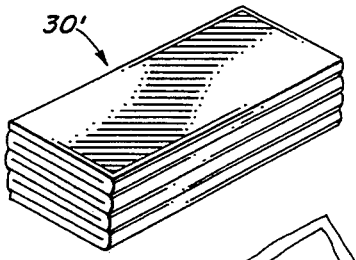
FIG. 3 is a detailed view of a portion of the template structure as shown in FIG. 2 in a compact, folded, or rolled configuration ready for storage.
Figure 4:
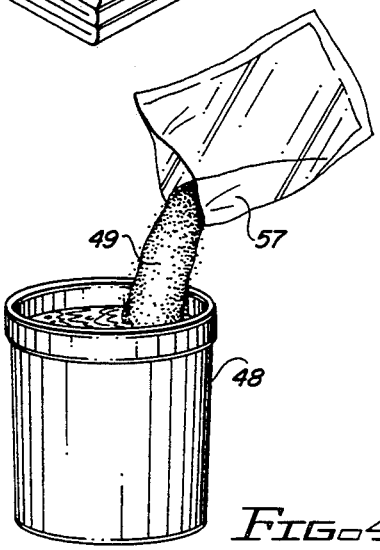
FIG. 4 is a perspective view of a mixing and/or storage container wherein the marking material initially formed as a powder concentrate and supplied to the user in a sealed plastic pouch is emptied into the container for mixing with water to form a liquid solution for application.

FIG. 1 represents one possible game court configuration which may be formed by application of the marking material of the present invention. More specifically, the game court is in the form of a half court basketball layout generally indicated as 10 and including side boundary lines 12 and 14 and an end boundary line 16. The general key or keyhole structure 18 of the basketball court 10 comprises a curved line defining the top of the keyhole 20, a foul line 22, and two elongated boundary lines 24 and 26 indicating the elongated boundaries of the keyhole 18 where the opposing players stand when a foul shot is taken. The game court may also include a three point line 28. As schematically shown in FIG. 1, the basketball court includes a hoop, backboard and pole 29.

Figure 2:
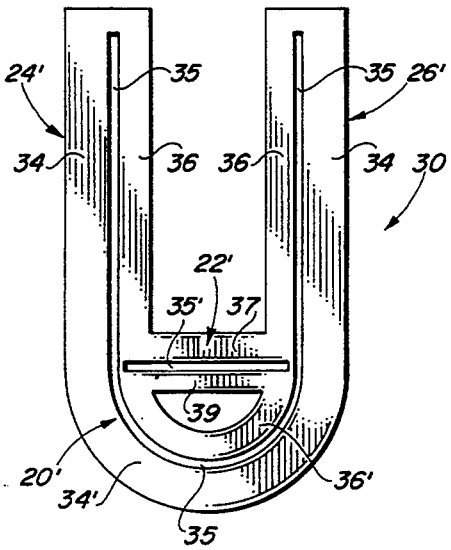
FIG. 2 is a top view of a template structure in its operative position.

To form the game court in accordance with the present invention, the user will first define the game court lines or general configuration on an outdoor hard surface. As shown in FIG. 2, the defining means comprises a template structure 30 formed of a plastic, vinyl or similar relatively high-strength but lightweight and flexible material. Flexibility of the template structure 30 allows it to be easily rolled or folded upon itself into a compact, reduced volume storage position 30', and quickly opened up into its operative position in which it is disposed in an outwardly extended, fully dimensioned and proper orientation overlaying a hard surface court 40 formed of concrete, black-top asphalt, or the like. The template structure 30 can be conveniently stored in its storage position 30' in an area of reduced size and volume.

The template structure 30 shown in FIG. 2 would be used to form a portion of the basketball game court, namely the keyhole configuration 18 (FIG. 1) of the half-court basketball layout 10. The template structure 30 may include outer boundary segments 34 and inner boundary segments 36 defining the two elongated side lines 24 and 26 by virtue of the dimension and configuration of the arms 24' and 26', respectively. The curved portion includes the same outer boundary segments 34' and 36' defining the top of the keyhole 20' (FIG. 2). The foul line segment 22' includes spaced apart segments 37 and 39. Between the segment pairs 34 and 36, 34' and 36', and 37 and 39, there are spaces 35 and 35'. These spaces 35 and 35' are provided so that any type of applicator may be used to apply a liquid solution of a marking material, described below in greater detail. The spaces 35 and 35' are equivalent in dimension and orientation to the intended game court segments 24, 26, 20, and 22 (FIG. 1).

The present invention includes a marking material of a non-toxic, clay-based composition comprising approximately 50% by volume of clay and 50% by volume of alumina hydrate. Alternatively, 50% by volume of silica can be substituted for the alumina hydrate, since both substances, as adapted for use in the present invention, share the property of providing resistance to removal of the marking material by frictional contact with a surface to which the marking material has been applied. The marking material is preferably in a powder concentrate form, and may include a coloring agent added in sufficient quantity to provide a desired coloring effect to the game court formed. This coloring agent may be a conventional food coloring, and can be one of any number of colors that would serve to enhance the overall appearance of the game court and the players' enjoyment of playing on that game court.

In the use of the present invention, the marking material in concentrated powder form may be supplied initially in a sealed plastic bag or like container 57 and poured by the user into the interior of a mixing and storage container 48. A predetermined quantity of water is then added to the storage container 48 and mixed with the marking material concentrate to form a liquid solution of the marking material. The quantity of water added will depend upon the quantity of concentrated marking material powder that has been poured into the storage container 48. A conventional paintbrush 50 is used to efficiently apply the liquid solution of marking material to the entire surface area of the spaces 35 and 35' in a series of paint strokes until the spaces 35 and 35' are thoroughly coated with the marking material. After the applied liquid solution of marking material has dried, the resulting keyhole configuration 18 will be fixedly attached to the exposed surface of the hard material court 40. Any excess marking material solution that was accidentally applied to the template structure 30 can be easily cleaned by rinsing with water, and then the template structure 30 can be folded up into its stored position 30' for use at a later date. When it is desired to remove the game court, the user can rinse or spray the hard court 40 with water using a conventional garden hose until the marking material is completely removed from the exposed surface.

Since many modifications, variations and changes in detail can be made to the described preferred embodiment of the present invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A system for forming a fixedly attached, removable game court on a concrete, black-top, or like hard surface, said assembly comprising:

a) means for defining the game court configuration on the hard surface;

b) a marking material having a composition and structure adapted for fixed, removable attachment to the hard surface, said marking material substantially including a clay-based composition of approximately 50% by volume of clay and approximately 50% by volume of a material selected from the group consisting of alumina hydrate and silica;

c) container means for holding and mixing therein a predetermined quantity of said marking material with a predetermined quantity of a fluid to form a liquid solution of said marking material; and d) applicator means structured for applying said liquid solution to the hard surface along said defined game court configuration.

2. A system as recited in claim 1 wherein said defining means comprises a template structure having a shape and dimension that defines an outline of the game court configuration, said template structure having an operative position in which said template structure is disposed in an outwardly extending and fully dimensioned orientation overlaying the hard surface.

3. A system as recited in claim 2 wherein said template structure is formed of a flexible material capable of being folded upon itself.

4. A system as recited in claim 3 wherein said template structure is structurally adapted to be selectively disposed into and out of said operative position and a stored position wherein said template structure has been folded upon itself into a collapsed, reduced volume state.

5. An system as recited in claim 1 wherein fixed, removable attachment of said marking material consists of resistance to removal from the hard surface by frictional contact therewith and susceptibility to removal from the hard surface by rinsing with water.

6. A system as recited in claim 1 wherein said marking material includes a coloring agent for providing a predetermined color to the marking material applied to the hard surface.

7. A process for forming a fixedly attached, removable game court on a concrete, black-top or like hard surface, said process comprising the steps of:

a) defining the game court configuration on the hard surface;

b) applying a liquid solution of a marking material to the hard surface along the defined game court configuration, said marking material having a structure and composition adapted for fixed, removable attachment to the hard surface, said marking material substantially including a clay-based composition of approximately 50% by volume of clay and approximately 50% by volume of a material selected from the group consisting of alumina hydrate and silica; and c) allowing said applied marking material solution to dry on the hard surface.

8. A process as recited in claim 7 wherein said game court configuration is defined by positioning a template structure onto an outer exposed surface of the hard surface, said template structure having a shape and dimension that defines an outline of said game court configuration, and said liquid solution of marking material is applied to the hard surface along said outline.

9. A process as recited in claim 7 wherein said step of applying a liquid solution of a marking material further includes applying a liquid solution of a marking material including a coloring agent for providing a predetermined color to said marking material applied to the hard surface.

10. A process as recited in claim 7, further comprising the step of placing a predetermined quantity of said marking material and a predetermined quantity of fluid into a container, and mixing said marking material and fluid in said container to form said liquid solution of marking material.

* * * * *